US006098608A

United States Patent [19]

Oshlick

[11] Patent Number: 6,098,608

[45] Date of Patent: Aug. 8, 2000

[54] BACKSIGHT ASSEMBLY FOR HUNTING BOW

[76] Inventor: William G. Oshlick, 11 Myers Ave., Jamestown, N.Y. 14701

[21] Appl. No.: 09/344,464

[22] Filed: Jun. 25, 1999

Related U.S. Application Data

[60] Provisional application No. 60/090,679, Jun. 25, 1998.

[51] Int. Cl.[7] ..... F41G 1/467

[52] U.S. Cl. ..... 124/87; 33/265

[58] Field of Search ..... 124/87; 33/265

[56] References Cited

U.S. PATENT DOCUMENTS

| | | | |
|---|---|---|---|
| 2,163,503 | 6/1939 | Tate | 124/23 |
| 3,849,894 | 11/1974 | Brougham | 33/265 |
| 4,020,560 | 5/1977 | Heck | 33/265 |
| 4,162,579 | 7/1979 | James | 33/265 |
| 4,317,288 | 3/1982 | Yasui | 33/265 |
| 4,542,591 | 9/1985 | Montgomery | 33/265 |
| 4,570,352 | 2/1986 | Leal | 33/265 |
| 4,977,678 | 12/1990 | Sears | 33/265 |
| 4,982,503 | 1/1991 | Land | 33/265 |
| 5,040,300 | 8/1991 | Sheffield | 33/265 |
| 5,414,936 | 5/1995 | Sappington | 33/265 |
| 5,507,272 | 4/1996 | Scantlen | 124/87 |
| 5,509,402 | 4/1996 | Sappington | 124/87 |
| 5,579,752 | 12/1996 | Nelson et al. | 124/87 |
| 5,657,740 | 8/1997 | Slates et al. | 124/87 |
| 5,671,724 | 9/1997 | Priebe | 124/87 |
| 5,735,053 | 4/1998 | McGunigal | 33/265 |
| 5,864,958 | 2/1999 | Giddens | 33/265 |

*Primary Examiner*—John A. Ricci
*Attorney, Agent, or Firm*—The Bilicki Law Firm, P.C.

[57] ABSTRACT

The subject back sight comprises a mounting member for mounting the backsight to the bow frame or to the front sight beneath the quiver mount, a support member extending from the mounting member, a first rod slidably engaged to the support member, a second rod slidably engaged to the first rod, a sighting member integral with the second rod, and three (3) engaging members for positively retaining: the first rod to the receptacle; the mounting member to the receptacle; and the second rod to the first rod.

16 Claims, 5 Drawing Sheets

BACKSIGHT ASSEMBLY FOR HUNTING BOW

This patent application claims priority to U.S. Provisional Patent Application, Ser. No. 60/090,679 filed on Jun. 25, 1998.

BACKGROUND

1. Field of the Invention

Archery bows are widely used both for target shooting and for use in hunting wild game. To improve the accuracy of the use of archery bows at different distances from the target, various sighting devices have been devised. Compound hunting bows typically are sold with mounting holes or attachment points on the bow above the bow's hand grip for attaching a sight assembly or assemblies to the bow. This invention relates generally to sighting devices for use with archery bows and more specifically to a back sight assembly which includes a mounting member, support member, receptacle, first rod, second rod, and a sighting member. The back sight assembly is mounted to the bow by means of a mounting member, from which extends a support member. The receptacle slideably engages the support member, and can be effectively adjusted and positively retained in an adjusted position, by means of a first engaging member, at any point along the support member. The first rod is also slideably engaged by the receptacle and it can be effectively adjusted and positively retained in an adjusted position, by means of a second engaging member. The second rod is slideably engaged by the first rod through a hole in the first rod, and can be effectively adjusted and positively retained in an adjusted position by means of a rod engaging member. At one end of the second rod is a sighting member for alignment with the desired yardage pin of the front sight assembly of the bow.

2. History of the Related Art

A variety of different types of sighting devices have been developed for use with archery bows, particularly those used for hunting. The most accurate of such prior art sighting devices employ both front and rear sight members which generally include provisions to compensate for the varying amounts of vertical drop or differing trajectories which occur when the selected targets are at different distances from the archer. While most such prior art bow sights improve the accuracy of a sighted bow over a non-sighted bow, significant disadvantages still result. It is difficult, for example, particularly in a hunting situation when the target is present for a relatively short period of time, to eliminate cant from the bow at the time it is sighted on the target and during the release of the arrow.

Patents which are directed to archery bow sights which include front and rear sight elements for improved accuracy are the U.S. Pat. No. 4,982,503 to Land; U.S. Pat. No. 4,162,579 to James; U.S. Pat. No. 4,417,403 to Strange; U.S. Pat. No. 4,494,313 to Scott; and U.S. Pat. No. 4,542,591 to Montgomery.

The James and Scott Patents disclose front and rear sight platforms which are attached to the bow riser. The rear sight is simply a notch (which is convertible to a circular or "peep" sight in James). The front sight embodies multiple pins located at different vertical spacings corresponding to various distances of the target from the bow. In James, the desired pin must be rotated into place each time a new distance is selected. The rear sight is located in close proximity to the archer's eye and the notch is aligned with the selected bead corresponding to the target distance. It is difficult to accurately align the notch (or the peep hole) with the selected bead, without introducing cant to the proper orientation of the to the archer. Also, in James, the rear sight extends past the string, which presents a problem.

The sight of the Montgomery Patent is similar in some respects to the one of the Scott Patent, but the rear sight is a peep sight which is mounted to the bow riser instead of the string. To use this sight, the bead in the rear or peep sight portion is aligned with a front bead selected to correspond with the shooting distance from the target. A sight of this type is difficult to align under low light conditions; and there is not provision for eliminating or reducing cant in the sight disclosed in the Montgomery Patent.

The fourth Patent of this group is the U.S. Pat. No. 4,417,403 to Strange. The sight of Strange includes a single front bead with a rotatable rear peep sight in which a pair of vertical and horizontal cross-hairs are mounted. The sight disclosed in the Strange Patent may be of some value for target shooting, but it is impractical for hunting. Under hunting conditions where the target distance must be approximated and rapidly selected, insufficient time would exist to adjust the rotational position of the rear sight to obtain any accuracy. Once again, there is no provision in the sight disclosed in the Strange Patent for eliminating or reducing cant of the bow.

The last of the Patent in this group is the Land Patent. The Land Patent is related to a front and rear bow sight system for attachment to an archery bow. It includes an elongated support member for rigid attachment of the sight to the bow, with a front sight member attached to the front of the support member, and a back sight member attached to the rear of the support member. Both the front and the rear sight members contain vertical and horizontal cross-hair pairs. The assembly is adjustable as respects both sight members so that when an archer has pulled the bow to its full draw, and to that archer's normal anchor, the horizontal and vertical cross-hairs of the front and rear sight members are superimposed upon one another. While the dual cross-hairs of the device as disclosed in Land provides a means to reduce cant, the superimposing of one cross-hair upon another in view of the thickness of the cross-hairs, obstructs the view of the archer and does not provide for a precise alignment of the cross-hairs' intersection with the desired yardage pin of the front sight, particularly when the front sight yardage pins are close together.

With specific reference to the back sight of the Land invention, the mounting portion is comprised of a mounting plate or block, a fixed rear extension and a slideable engagement rod moveable thereabout for movement of the sight toward and away from the archer. In addition, the back sight is capable of being adjusted in both the horizontal and vertical planes. The adjustment of the Land invention is accomplished by threading fasteners into spaced pairs of holes in the fixed rear extension. Therefore, continuous adjustment of the back sight along the length of the fixed rear extension is not available. Further, the Land Patent does not teach that its archery bow sight is capable of being mounted to any existing conventional front sight.

SUMMARY OF THE INVENTION

Accordingly, it is an object of the present invention to provide a back sight that is universally mountable to any conventional front sight below the quiver mount, including state-of-the-art sights such as those manufactured by Tru-Glo. In addition, the present invention provides a back sight that is also universally mountable to the bow frame.

It is an additional object of the present invention to permit a more precise alignment with the desired pin of a conventional front sight; thereby enabling the user to achieve greater target accuracy.

It is also an object of the present invention to provide a back sight that is adjustable in three planes: toward and away from the archer, up and down in the plane parallel to the bow frame, and side to side in the plane perpendicular to the bow frame.

It is a further object of the present invention to provide for easy use of the back sight assembly by a wide variety of archers in terms of their physical size and dimensions such as height and arm length.

It is also an object of the present invention to provide for easy sighting of the bow by a professional archery shop without the individual archer being present.

In accordance with a preferred embodiment of this invention, the subject back sight comprises a mounting member for mounting the backsight to the bow frame or to the front sight beneath the quiver mount, a support member extending from the mounting member, a first rod slidably attached to the mounting member, a second rod slidably attached to the first rod, a sighting member integral with the second rod, and a set of three (3) set screws for positively retaining: the first rod to the receptacle; the mounting member to the receptacle; and the second rod to the first rod.

DETAILED DESCRIPTION OF THE PREFERRED EMBODIMENT

The preferred embodiment of the subject back sight comprises a mounting member preferably being, a block for mounting the backsight to the bow frame or to holes provided by conventional front sights for attaching a quiver mount, a support member extending from the mounting member, a first rod slidably attached to the support member, a second rod slidably attached to the first rod, an adjustable sight integral with the second and a set of three (3) set screws for positively retaining: the first rod to the receptacle; the support member rod to the receptacle; and the second rod to the first rod.

Figure 1:
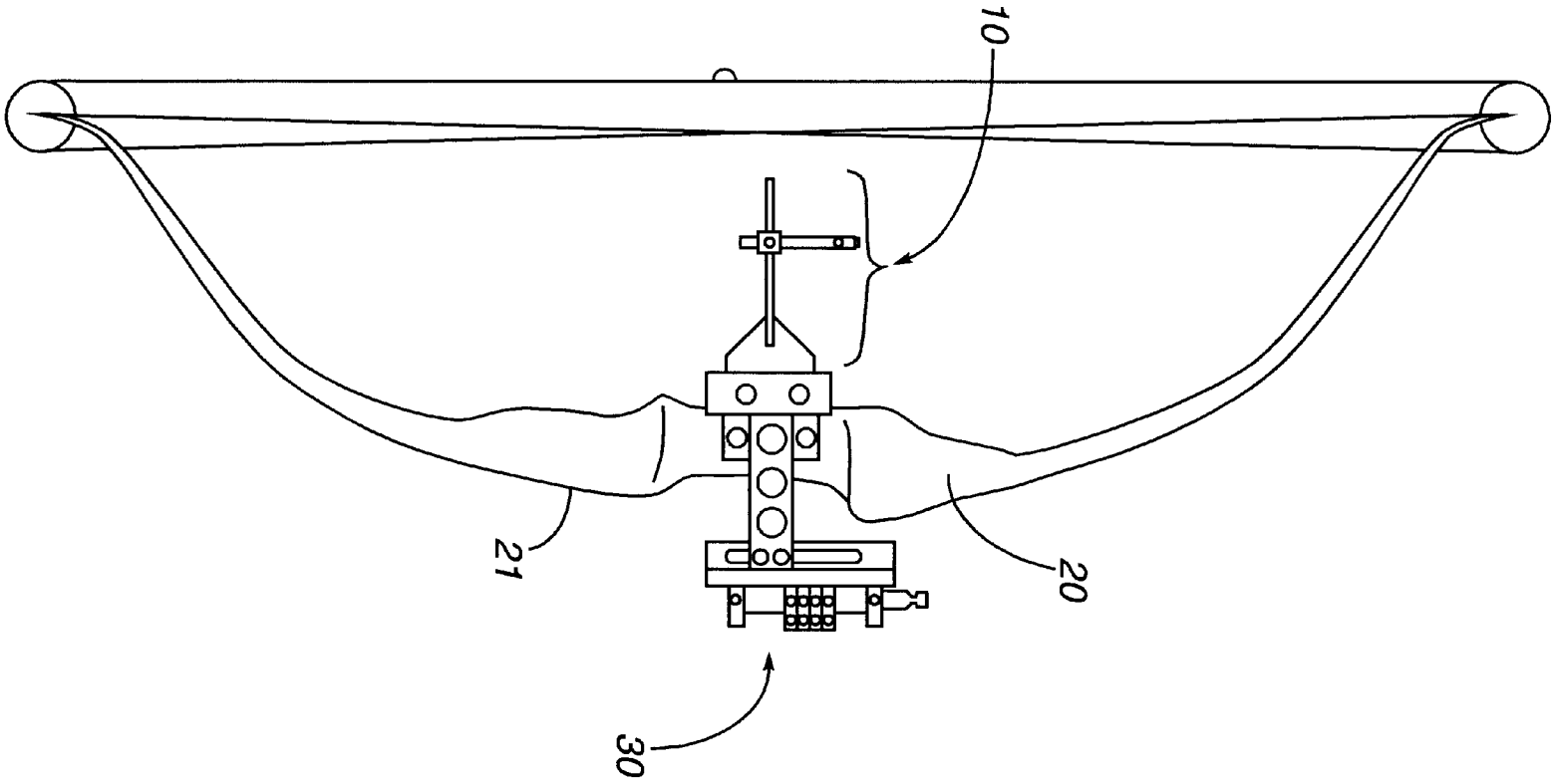
FIG. 1 illustrates a side view of a conventional bow and front sight. It also illustrates the location of the subject backsight and its connection with a conventional front sight.

The archery bow sight is illustrated in FIG. 1 in a side view that depicts the overall manner in which the various components are attached to the bow and to one another. FIGS. I and 2 show mounting plate 11 fixedly attached to the quiver mounting holes integral with conventional front sight 30. However, as one of ordinary skill in the art will appreciate, back sight assembly 10 can also be fixedly attached directly to the bow frame 20. Both front sight 30 and back sight assembly are mounted above hand grip 21 and arrow rest (not shown). Back sight assembly 10 is, therefore, in line with conventional front sight assembly 30.

Figure 2:
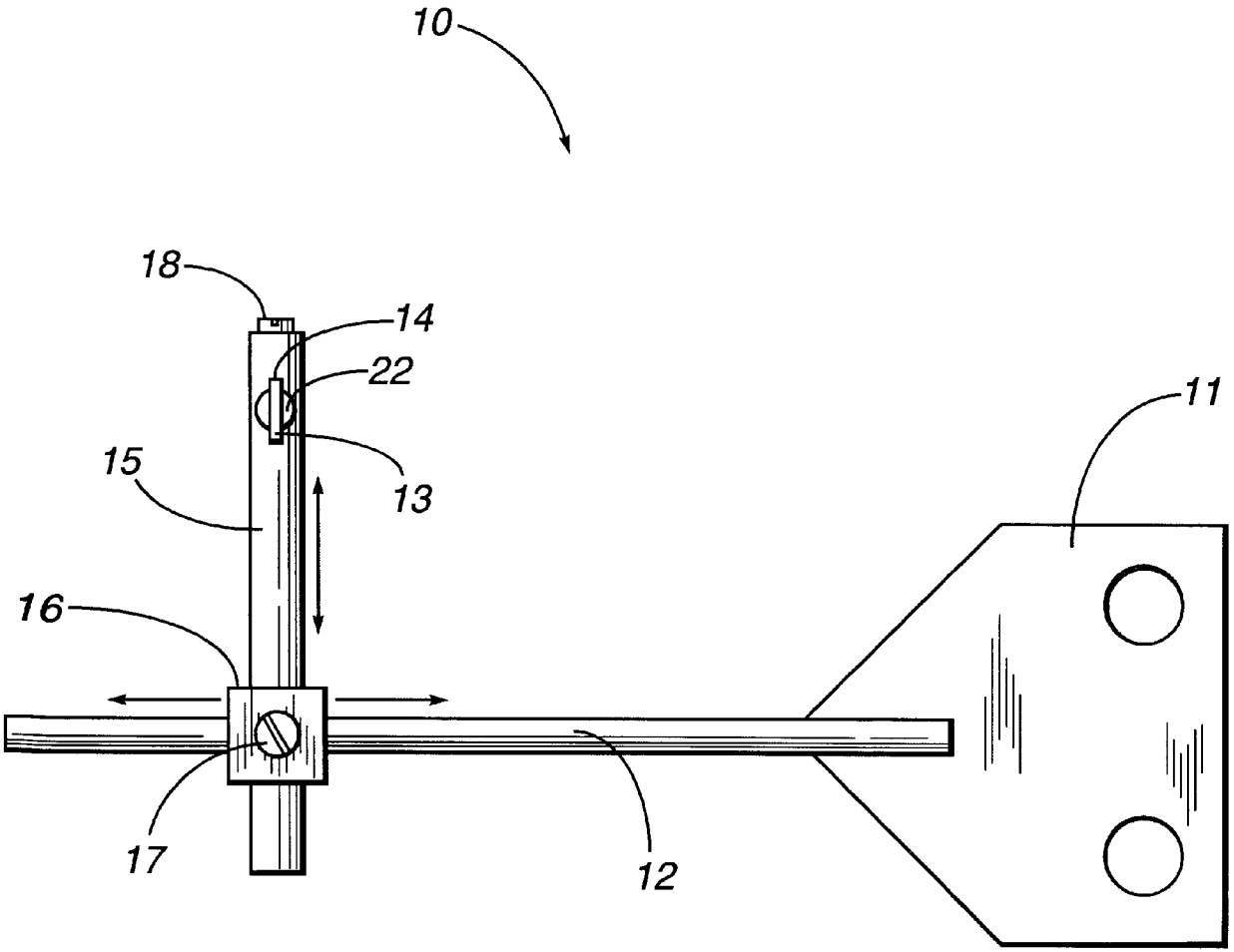
FIG. 2 is a side view of the subject backsight.
Figure 3:
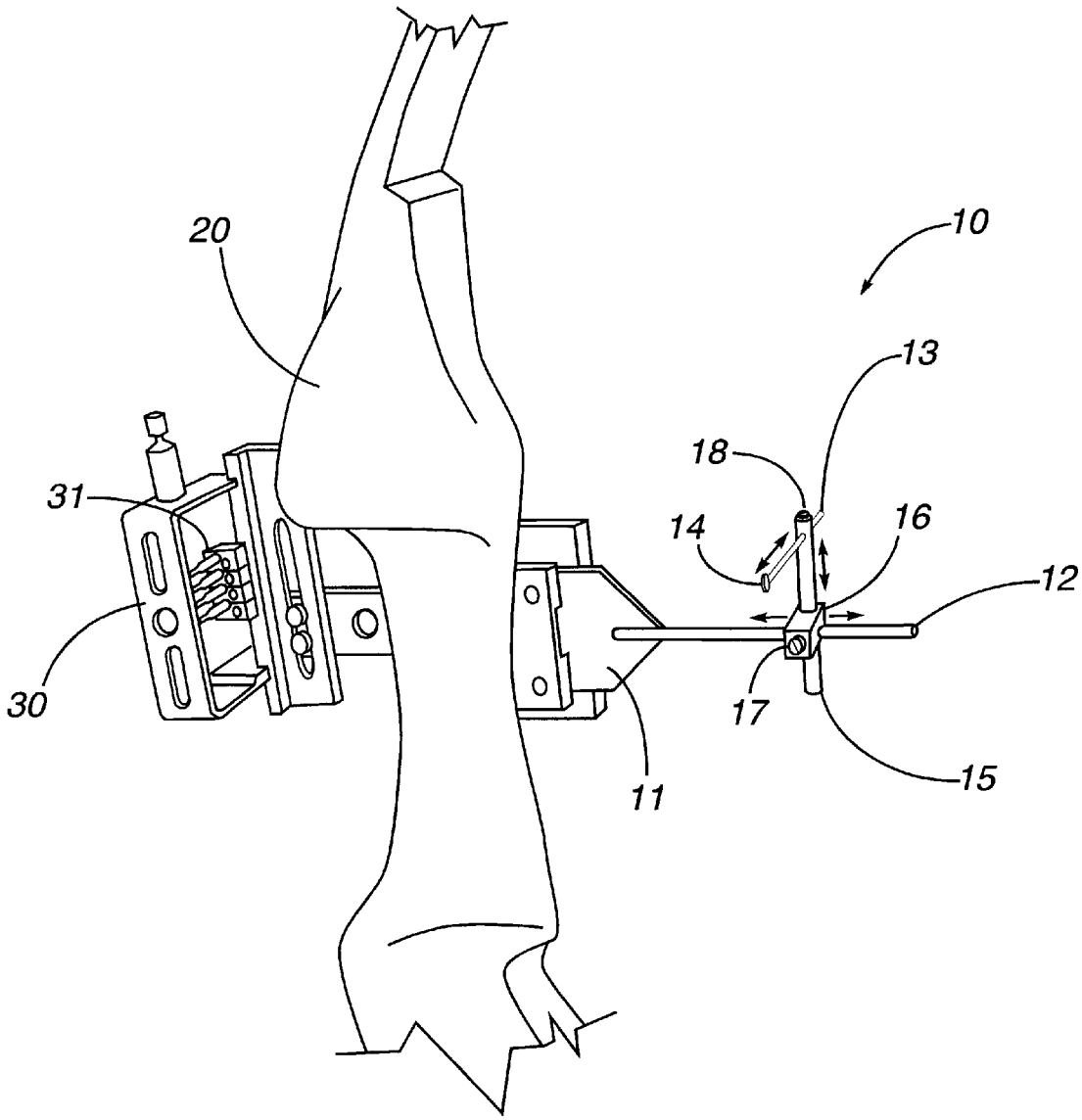
FIG. 3 is a side elevational view of the subject backsight.

Back sight assembly 10 is shown in detail in FIG. 2. Mounting plate 11 or, most preferably, a block (not shown) is fixedly attached to the holes provided by conventional front sights for the attaching a quiver mount. In addition, the mounting plate or block can be fixedly attached to bow frame 20. A fixed horizontal rod 12 is integral with and extends from the mounting plate 11 as shown in FIG. 2. A slideable rod receptacle 16 slideably engages the fixed horizontal rod 12 so that the receptacle 16 can be moved continuously along fixed horizontal rod 12. A first set screw 19 threadably engages rod receptacle 16 and fixed horizontal rod 12 so that slideably engaged receptacle 16 is capable of being positively retained or locked at any number of positions along horizontal rod 12. A vertical rod 15 is slideably engaged in rod receptacle 16 along the entire length of vertical rod 15. A second set screw 17 threadably engages rod receptacle 16 and vertical rod 15 so that when slideably engaged, receptacle 16 is capable of being positively retained or locked at any number of positions along vertical rod 15. Vertical rod 15 includes hole 22 positioned at one end of said rod for purposes of a slideably engaging horizontal rod 13. Horizontal rod 13 is slideably engaged along its entire length within hole 22 of vertical rod 15. A third set screw 18 threadably engages vertical rod 15 and slideable horizontal rod 13 so that horizontal rod 13 can be locked at any number of positions along the length of horizontal rod 13. As shown in FIG. 3, a sight 14 is integral with and positioned at one end of the slideable horizontal rod 13. The sight 14 may be encircled with a ring 23 for initial alignment. The sight 14 of the back sight assembly must be aligned with the yardage shooting pins 31 usually found in conventional front sights 30 as shown in detail in FIG. 4. In the preferred embodiment, the fixed horizontal rod, the slideable horizontal rod, and the slideable vertical rod may be milled to form a flat face to facilitate a more positive locking of the rods in various positions.

Figure 4:
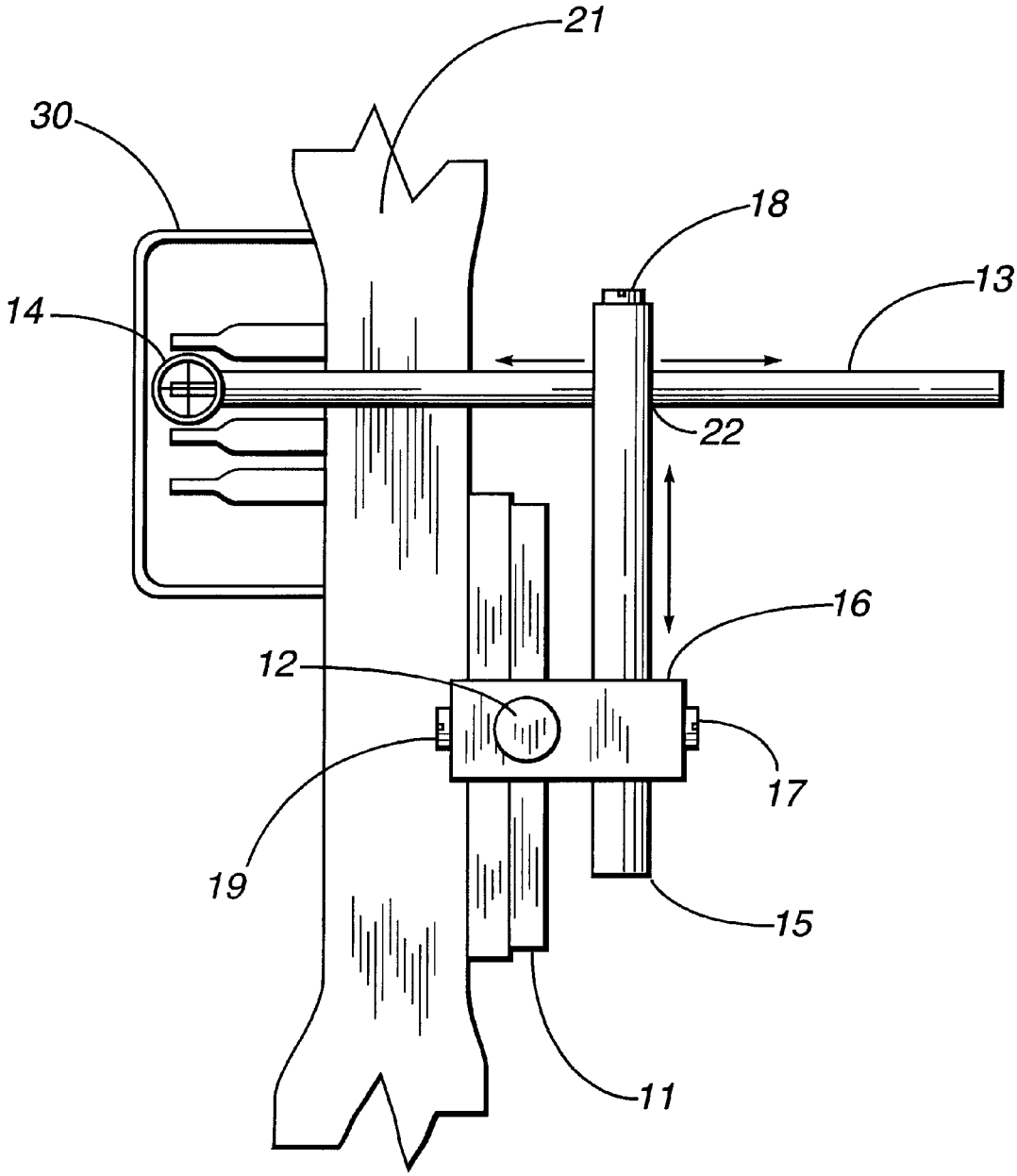
FIG. 4, shows a view of the backsight from the user's perspective.
Figure 5A:
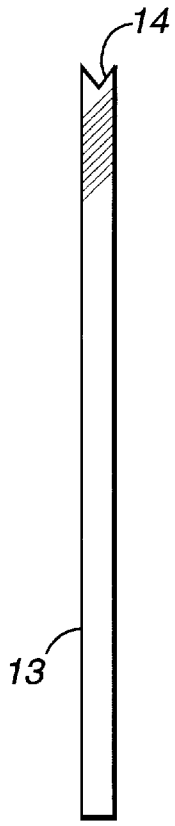
FIG. 5*a* shows an exploded view of the preferred embodiment of the sighting member, known as a notch sight, from the user's perspective.
Figure 5B:
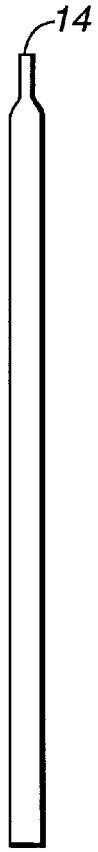
FIG. 5*b* shows an exploded side view of the notch sight.
Figure 5C:
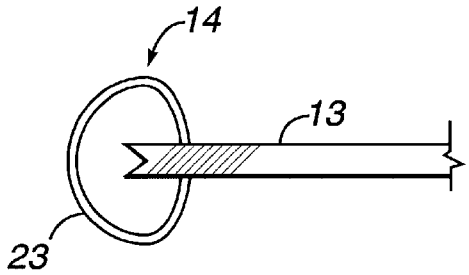
FIG. 5*c* shows an exploded end view of the notch sight encircled by a ring.

FIG. 3 illustrates the interaction of the above-described components of the back sight assembly with the bow and the conventional front sight. FIG. 4 shows a view of the back sight from a user's perspective. In particular, FIG. 4 depicts how the slideable horizontal rod is to be aligned with the conventional front sight. As is obvious from the above description, the user of this back sight assembly can adjust the back sight in many directions and along many different axes to allow for precise alignment with the conventional front sight and, therefore, greater accuracy with respect to the targets. FIG. 5*a*, FIG. 5*b*, and FIG. 5*c* depict the embodiment of the slideable horizontal rod 13 and notch sight 14. Various types of sights may be used from cross hairs to notches; however, the preferred sight is the notch sight. The closer sight 14 is to the archer, the easier it is for the archer to align the sight 14 with the desired yardage pin of the front sight assembly.

The back sight assembly described above is versatile in that it can be continuously adjusted in three planes: toward and away from the archer, up and down in the plane parallel to the bow frame, and side to side in the plane perpendicular to the bow frame. The back sight assembly is also adaptable for right or left handed bows. Any combination of points along the vertical rod, the slideable horizontal rod, and the fixed horizontal rod can be chosen to precisely align the tip of the slideable horizontal rod with any one of the yardage shooting pins usually found in conventional front sights attached to bows.

Although the invention is described by reference to a specific preferred embodiment, it is clear that variations can be made without departing from the spirit of the invention as claimed.

I claim:

1. A backsight for use in combination with a front sight of a hunting bow comprising:

a mounting member secured to said bow;

a support member, having a first end and a second end, said first end secured to said mounting member;

a receptacle adapted to receive said support member at said second end, said receptacle also having a first engaging member and a second engaging member, said first engaging member adapted to rigidly secure said receptacle to said support member at a selected point along a continuum of points along said support member;

a first rod, slidably engaged within said receptacle, and having a rod engaging member, said second engaging member adapted to rigidly secure said first rod to said receptacle at a selected point along a continuum of points along said first rod, said first rod adapted to receive a second rod, said second rod slidably engaged within said first rod, said rod engaging member of said first rod adapted to rigidly secure said second rod to said first rod at a selected point along a continuum of points along said second rod; and, a sighting member, secured to one end of said second rod, for alignment with said front sight.

2. The backsight as recited in claim 1 wherein said sighting member is a cross-hair.

3. The backsight as recited in claim 1 wherein said sighting member comprises a notched member such that the notch may be aligned with the front sight.

4. The backsight as recited in claim 1 wherein said sighting member comprises a pointed member such that the point may be aligned with the front sight.

5. The backsight as recited in claim 1 wherein said sighting member additionally comprises a ring surrounding said sighting member.

6. The backsight as recited in claim 1 wherein said support member is secured in a position substantially perpendicular to a frame of said bow; and, wherein said first rod is secured in a position substantially perpendicular to said support member, and said second rod is secured in a position substantially perpendicular to said first rod.

7. The backsight as recited in claim 1 wherein said mounting plate is adapted to receive a quiver mount.

8. The backsight as recited in claim 1 wherein said first engaging member, said second engaging member, and said rod engaging member are set screws.

9. A backsight for use in combination with a front sight of a hunting bow comprising:

a mounting member having a first end and a second end, said first end secured to said bow;

a receptacle adapted to receive said mounting member at said second end, said receptacle also having a first engaging member and a second engaging member, said first engaging member adapted to rigidly secure said receptacle to said mounting member at a selected point along a continuum of points along said mounting member;

a first rod, slidably engaged within said receptacle, and having a rod engaging member, said second engaging member adapted to rigidly secure said first rod to said receptacle at a selected point along a continuum of points along said first rod, said first rod adapted to receive a second rod, said second rod slidably engaged within said first rod, said rod engaging member of said first rod adapted to rigidly secure said second rod to said first rod at a selected point along a continuum of points along said second rod; and, a sighting member, secured to one end of said second rod, for alignment with said front sight.

10. The backsight as recited in claim 9 wherein said sighting member is a cross-hair.

11. The backsight as recited in claim 9 wherein said sighting member comprises a notched member such that the notch may be aligned with the front sight.

12. The backsight as recited in claim 9 wherein said sighting member comprises a pointed member such that the point may be aligned with the front sight.

13. The backsight as recited in claim 9 wherein said sighting member additionally comprises a ring surrounding said sighting member.

14. The backsight as recited in claim 9 wherein said support member is secured in a position substantially perpendicular to a frame of said bow; and, wherein said first rod is secured in a position substantially perpendicular to said support member, and said second rod is secured in a position substantially perpendicular to said first rod.

15. The backsight as recited in claim 9 wherein said mounting plate is adapted to receive a quiver mount.

16. The backsight as recited in claim 9 wherein said first engaging member, said second engaging member, and said rod engaging member are set screws.

* * * * *